US009016513B2

(12) United States Patent
Kulack et al.

(10) Patent No.: US 9,016,513 B2
(45) Date of Patent: Apr. 28, 2015

(54) TANK SPLASHGUARD WITH MULTI-TIERED LABYRINTH

(71) Applicant: Caterpillar Inc., Peoria, IL (US)

(72) Inventors: Thomas Kulack, Algonquin, IL (US); Nathanael McRostie, Oswego, IL (US); Michael Zolvinski, Bolingbrook, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 13/691,586

(22) Filed: Nov. 30, 2012

(65) Prior Publication Data

US 2014/0151384 A1 Jun. 5, 2014

(51) Int. Cl.
*B65D 25/02* (2006.01)

(52) U.S. Cl.
CPC ..... *B65D 25/02* (2013.01)

(58) Field of Classification Search
CPC ..... B65D 25/02; B60K 15/077
USPC ..... 220/731, 4.12, 4.14, 369, 373, 374, 220/DIG. 21, 86.2, 719, 86.3, 745, 746, 220/747, 89.1; 137/582, 587, 377; 55/385.4, 320, 462, 465, 442, 443, 444
See application file for complete search history.

(56) References Cited

U.S. PATENT DOCUMENTS 1,047,517 A 12/1912 Harris
1,841,691 A 1/1932 Wilson
2,050,793 A * 8/1936 Hille ..... 220/86.3
(Continued)

FOREIGN PATENT DOCUMENTS

JP 59 110975 6/1984
JP 2000-038039 2/2000
(Continued)

OTHER PUBLICATIONS

Pending U.S. Patent Application, entitled "Tank Breather Assembly and Mounting Configuration," filed Nov. 30, 2012.
(Continued)

*Primary Examiner* — Fenn Mathew
*Assistant Examiner* — Robert Stodola
(74) *Attorney, Agent, or Firm* — Finnegan, Henderson, Farabow, Garrett & Dunner, LLP

(57) ABSTRACT

A splashguard is disclosed for use with a tank. The splashguard may include a main channel formed by an elongated base plate and side walls extending generally orthogonally from the elongated base plate by a first distance. The splashguard may also include a first end channel formed by a base plate and side walls extending generally orthogonally from the base plate by a second distance greater than the first distance. The first end channel may also be formed by an end wall extending generally orthogonally from the base plate by the second distance. The splashguard may further include a second end channel substantially identical to the first end channel. A first flow path may be maintained between the elongated base plate of the main channel and the base plate of the first end channel. A second flow path may be maintained between the elongated base plate of the main channel and the base plate of the second end channel.

20 Claims, 4 Drawing Sheets

(56) References Cited

U.S. PATENT DOCUMENTS

| | | | | | |
|---|---|---|---|---|---|
| 3,152,604 | A | | 10/1964 | Frye et al. | |
| 3,804,291 | A | | 4/1974 | Fricker | |
| 3,990,602 | A | * | 11/1976 | Hollins | 220/86.3 |
| 4,531,653 | A | | 7/1985 | Sakata | |
| 5,305,908 | A | * | 4/1994 | Otto et al. | 220/564 |
| 5,558,244 | A | * | 9/1996 | Akaike et al. | 220/374 |
| 6,575,326 | B2 | | 6/2003 | Martin, Jr. | |
| 2010/0110631 | A1 | * | 5/2010 | Fong et al. | 361/695 |

FOREIGN PATENT DOCUMENTS

| | | | | |
|---|---|---|---|---|
| JP | 2005-220943 | | | 8/2005 |
| KR | 2005117351 | A | * | 12/2005 |

OTHER PUBLICATIONS

Pending U.S. Patent Application, entitled "Hydraulic System Having Dual Manifolds," filed Nov. 30, 2012.

* cited by examiner

TANK SPLASHGUARD WITH MULTI-TIERED LABYRINTH

TECHNICAL FIELD

The present disclosure relates generally to a splashguard and, more particularly, to a tank splashguard having a multi-tiered labyrinth.

BACKGROUND

Machines such as a wheel loaders, wheeled scrapers, track-type tractors, on and off-highway haul trucks, motor graders, and other heavy equipment generally include hydraulic systems that facilitate different operations of the machines, including steering, braking, and implementation operations, among others. Hydraulic systems generally include an assembly of components that work together to deliver pressurized hydraulic fluid to drive the operations of the machines. Typically, hydraulic systems include a fluid tank dedicated to holding and filtering a desired supply of hydraulic fluid.

During operation of the machine, hydraulic fluid housed in the fluid tank can churn and splash onto a top portion of the fluid tank. The hydraulic fluid can enter a filter element located within a breather, which can accelerate the wear of the breather and reduce its durability. Hydraulic fluid entrained in the air can also be discharged into the environment. The entrained hydraulic fluid can coat the surface and internal pathways of the breather, as well as the surrounding fluid tank surface. This coating can attract dust, dirt, and other pollutants, which can accumulate in the internal pathways of the breather and block the passage of air into and out of the fluid tank. This can undermine the breather's ability to maintain the fluid tank at a desired pressure, which can result in structural damage to the fluid tank. Additionally, the discharge of hydraulic fluid into the environment can present environmental concerns. The accumulation of dust, dirt, and other pollutants on the breather and the surface of the fluid tank can also result in an aesthetically displeasing appearance.

One attempt to reduce the splashing of undesirable fluids within a tank is described in U.S. Pat. No. 1,841,691 to Wilson ("the '691 Patent") that issued on Jan. 19, 1932. The '691 Patent discloses a tank that includes a stamped metal disk extending from a top of the tank. The stamped metal disk includes inclined sides intended to prevent the splashing of liquids near the top portion of the tank and a small central opening for the passage of air. To exit the tank through the breather, air laden with vapors must pass through the small central opening, a row of apertures along vertical walls of a washer, and a receptacle with a perforated bottom to reach an absorbent material. The absorbent material absorbs the undesirable vapor, entrains the air with moisture, and discharges the moisturized air into the atmosphere. A pan is positioned above the stamped metal disc to further preclude any liquids that manage to splash up through the small central opening and to return the liquids back to the tank.

Although adequate for some applications, the configuration disclosed in the '691 Patent may be less than optimal. This is because the small central opening may be too small to properly maintain atmospheric pressure in the tank. Additionally, liquids splashing and churning in the tank may reach the small central opening and further block the passage of air. Similar blockage may occur when liquids striking the stamped metal disk are returned to the tank via the small central opening.

The splashguard of the present disclosure solves one or more of the problems set forth above and/or other problems in the art.

SUMMARY

In one aspect, the present disclosure is directed to a splashguard for a tank. The splashguard may include a main channel having a first open end and a second open end. The main channel may be formed by an elongated base plate having a first length and a second length and side walls extending generally orthogonally from the first length of the elongated base plate by a first distance. The side walls may be configured to connect to an upper wall of the tank. The splashguard may also include a first end channel located at the first open end of the main channel. The first end channel may be formed by a base plate having a first length and a second length and side walls extending generally orthogonally from the first length of the base plate by a second distance greater than the first distance. The first end channel may also be formed by an end wall extending generally orthogonally from the second length of the base plate by the second distance. The side walls and the end wall may be configured to connect to the upper wall of the tank. The splashguard may further include a second end channel substantially identical to the first end channel. The second end channel may be located at the second open end of the main channel. A first flow path may be maintained between the elongated base plate of the main channel and the base plate of the first end channel. A second flow path may be maintained between the elongated base plate of the main channel and the base plate of the second end channel.

In another aspect, the present disclosure may be directed to a splashguard for a tank. The splashguard may include a main channel having a first open end and a second open end. The main channel may be formed by an elongated base plate having a first length and a second length and side walls extending generally orthogonally from the first length of the elongated base plate by a first distance. The side walls may be configured to connect to an upper wall of the tank. The splashguard may also include a first end channel located at the first open end of the main channel. The first end channel may be formed by a base plate having a first length and a second length and side walls extending generally orthogonally from the first length of the base plate by a second distance greater than the first distance. The first end channel may also be formed by an end wall extending generally orthogonally from the second length of the base plate by the second distance. The side walls and the end wall may be configured to connect to the upper wall of the tank. The splashguard may further include a second end channel substantially identical to the first end channel. The second end channel may be located at the second open end of the main channel. A first flow path may be maintained between the elongated base plate of the main channel and the base plate of the first end channel. A second flow path may be maintained between the elongated base plate of the main channel and the base plate of the second end channel. The elongated base plate of the main channel may be spaced apart from the upper wall of the tank by about 27-33 millimeters. The base plates of the first and second end channels may be spaced apart from the elongated base plate of the main channel by about 9-15 millimeters. The side walls of the first and second end channels may overlap the side walls of the main channel by about 72-78 millimeters. The side walls of the first and second end channels may be spaced apart from the side walls of the main channel by about 19.5-25.5 millimeters.

DETAILED DESCRIPTION

Figure 1:
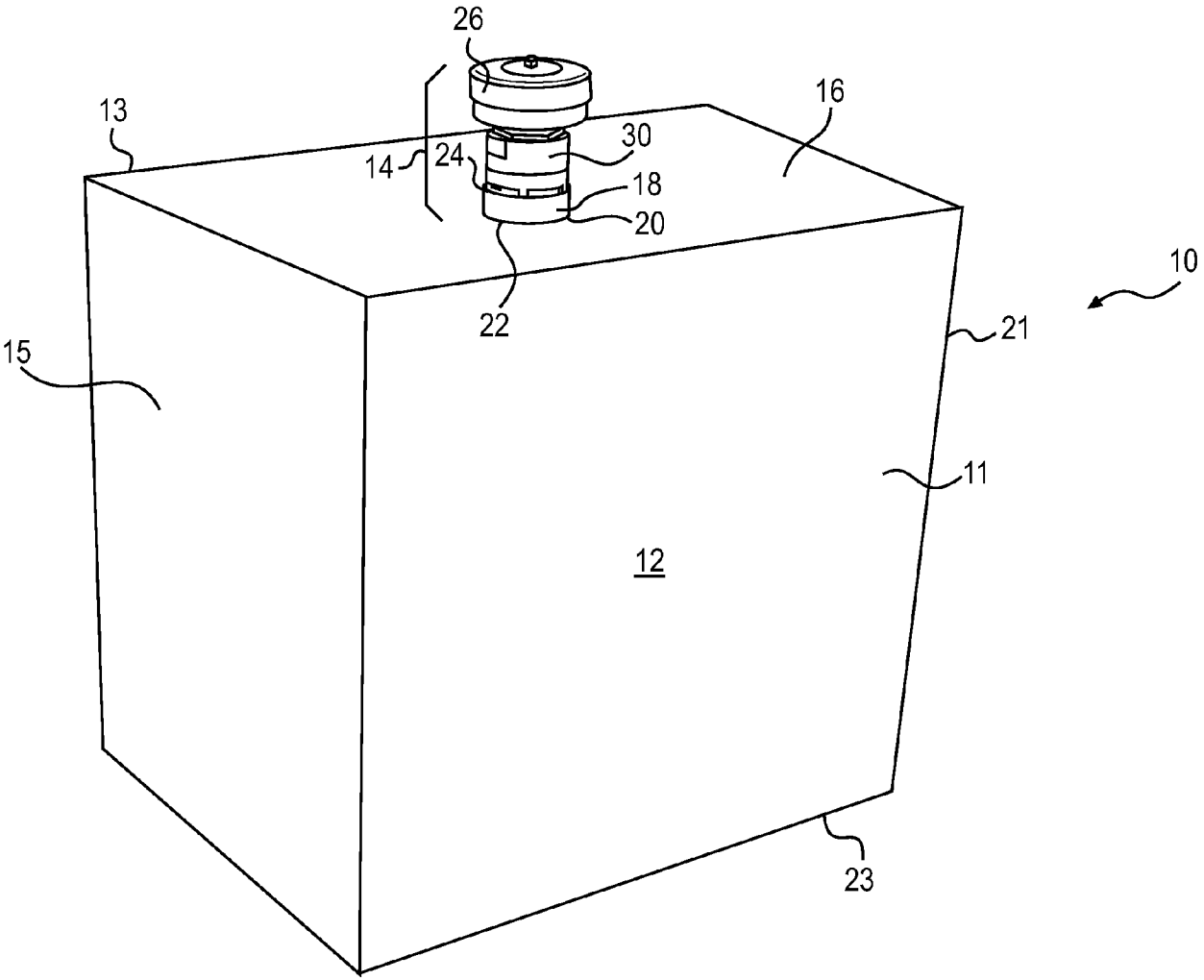
FIG. 1 is a perspective view illustration of an exemplary disclosed tank assembly.

FIG. 1 illustrates an exemplary embodiment of a tank assembly 10. Tank assembly 10 may include a fluid tank 12 and a breather assembly 14. Fluid tank 12 may include a front wall 11, a rear wall 13, a left-side wall 15, a right-side wall 21, an upper wall 16, and a bottom wall 23 that together substantially enclose a volume. Fluid tank 12 may serve as a reservoir configured to hold a supply of fluid. The fluid may include, for example, a dedicated hydraulic oil, an engine lubrication oil, a transmission lubrication oil, a fuel, or any other fluid known in the art. One or more hydraulic systems within a machine (not shown) may draw fluid from and return fluid to fluid tank 12.

Fluid tank 12 may further include an integral spout 18 located at about a general center of upper wall 16 at a circular opening 20. Integral spout 18 may be a hollow cylindrical body extending away from upper wall 16 and having a base end 22 and a distal end 24. Base end 22 may be open to an interior of fluid tank 12 via opening 20. Integral spout 18 may be configured to receive breather assembly 14 at distal end 24. In the disclosed embodiment, integral spout 18 is attached to fluid tank 12 at base end 22 by way of welding. It is contemplated, however, that integral spout 18 can alternatively be attached to fluid tank 12 by way of a threaded interface at base end 22 or integrally formed (e.g., via rotational molding from a high-density polyethylene plastic material).

Figure 2:
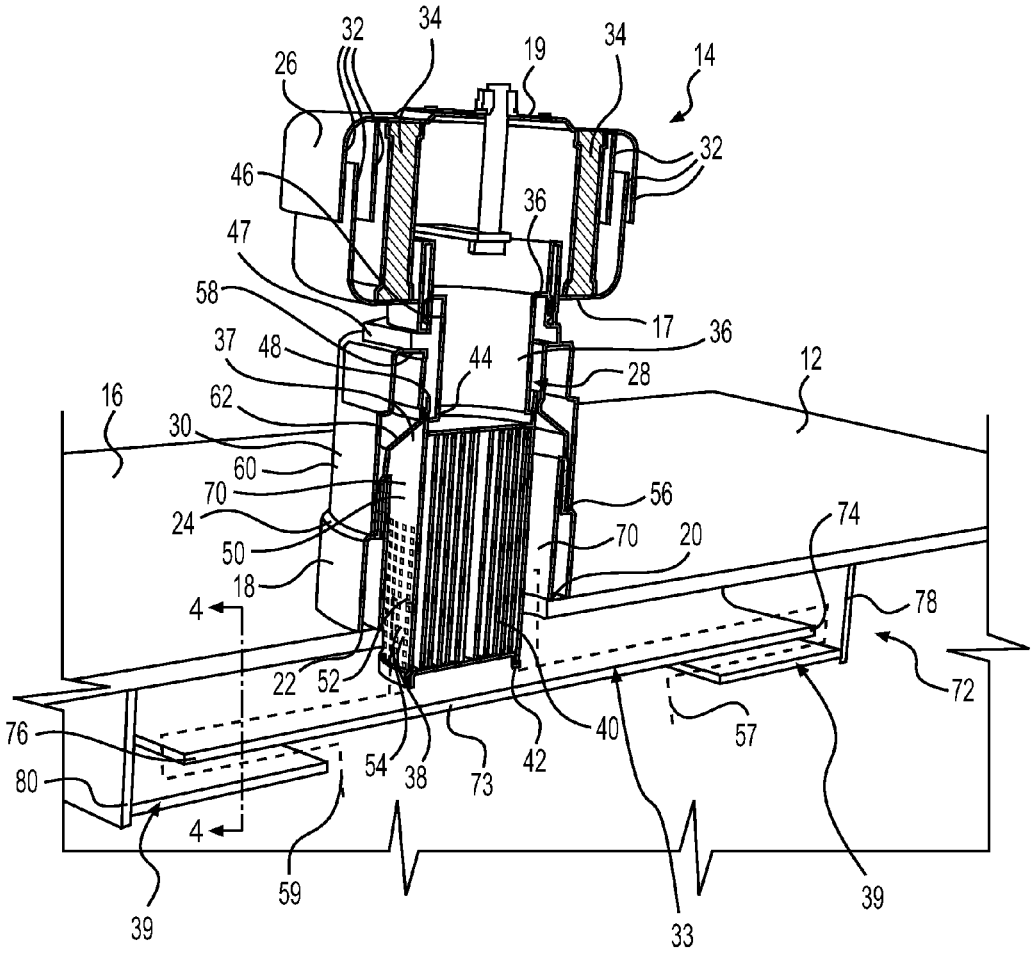
FIG. 2 is a cut-away perspective view illustration of an exemplary disclosed splashguard.

As shown in FIG. 2, breather assembly 14 may function to allow air into and/or out of fluid tank 12 during draining and filling of fluid tank 12. For example, breather assembly 14 may allow air into fluid tank 12 to replace a volume of fluid tank 12 previously occupied by hydraulic fluid that has been consumed by an associated hydraulic system. Similarly, breather assembly 14 may allow air out of fluid tank 12 to permit space for the hydraulic fluid returning to fluid tank 12.

Breather assembly 14 may include a breather cap 26, an elongated breather insert 28 extending downward from breather cap 26 into integral spout 18, and a mounting collar 30 attaching breather assembly 14 to fluid tank 12. Breather cap 26 may be a generally cylindrical body having a base end 17 and a distal end 19 and including overlapping annular walls 32. In the disclosed embodiment, breather cap 26 includes three annular walls 32 radially spaced apart from each other and surrounding an I-shaped filter media 34.

Air may enter breather assembly 14 from a perimeter of breather cap 26 and navigate via a serpentine pattern around ends of annular walls 32 and through filter media 34 to reach an axial end of breather insert 28. Filter media 34 may be configured to inhibit movement of debris passing through breather assembly 14, to separate the debris from the air. Filter media 34 may be formed from a porous or mesh material. In the disclosed embodiment, filter media 34 is fabricated from a phenolic resin-impregnated paper. The debris may be maintained within filter media 34. In this manner, air may be provided with a passageway to breather insert 28 while also hindering an ability of other elements, such as rain, to enter fluid tank 12.

Breather insert 28 may include a plurality of components that function together to cleanse air traveling through breather assembly 14. Breather insert 28 may include, among other things, a coupling 36, a screen 38, a filter media 40, and an obstructing rim 42. Coupling 36 may include a first end 44 and an opposing second end 46 and may generally form a hollow conduit. First end 44 of coupling 36 may include threads to receive mounting collar 30. Second end 46 of coupling 36 may attach to base end 17 of breather cap 26, In the disclosed embodiment, second end 46 of coupling 36 also includes threads to receive base end 17 of breather cap 26, although other ways to connect coupling 36 with breather cap 26 may be utilized. Coupling 36 may also include a flange 47 encircling a perimeter of coupling 36 and positioned slightly below second end 46 (i.e., between first end 44 and second end 46). Flange 47 may form an interface between breather cap 26 and mounting collar 30 and help seal breather cap 26 to mounting collar 30. Coupling 36 may connect to screen 38 at first end 44. In particular, first end 44 may include an annular groove 48 that receives screen 38. In the disclosed embodiment, screen 38 is aluminum. It is contemplated, however, that screen 38 may be assembled from any suitable material known in the art, for example, from a plastic or other non-corrosive metal.

Screen 38 may include a generally solid upper half 50 and a perforated lower half 52. Perforated lower half 52 may be characterized by apertures 54 arranged in axially spaced rows. It is contemplated that apertures 54 may be of variable diameters or consistent diameters. In the disclosed embodiment, apertures 54 generally have consistent diameters of about 2-4 millimeters. Perforated lower half 52 may be in general alignment at its upper end with distal end 24 of integral spout 18. Perforated lower half 52 of screen 38 may be configured to block passage of large debris through breather assembly 14.

Screen 38 may be open at its upper end (i.e., at upper half 50) and closed at its lower end (i.e., at lower half 52) by obstructing rim 42. Obstructing rim 42 may force air to flow in a radial direction through apertures 54 of screen 38 by substantially blocking vertical airflow into or out of fluid tank 12 via a direct axial path through breather insert 28. It is also contemplated that obstructing rim 42 may be perforated to permit some vertical airflow into or out of fluid tank 12 via a direct axial path through breather insert 28.

Screen 38 may provide an outer form to enclose and support filter media 40. Filter media 40 may be formed from a porous or mesh material arranged in a regularly or irregularly shaped pattern. In the disclosed embodiment, filter media 40 is fabricated from a wire mesh. Filter media 40 may be configured to inhibit movement of hydraulic fluid entrained in air passing through breather assembly 14, to separate the hydraulic fluid from the air. The hydraulic fluid prevented from flowing through breather assembly 14 and out of fluid tank 12 may drain from filter media 40, downward under the force of gravity through a splashguard 72 (described in greater detail below), and back into fluid tank 12.

Mounting collar 30 may be generally cylindrical and configured to fixedly retain breather assembly 14 connected to integral spout 18. Mounting collar 30 may have a height of about 70-84 millimeters and a diameter of about 113-127 millimeters. In the disclosed embodiment, mounting collar 30 has a height of about 77 millimeters and a diameter of about 120 millimeters, Mounting collar 30 may include circular openings at a first end 56 and an opposing second end 58. First end 56 may include threads to engage distal end 24 of integral spout 18. Second end 58 may include threads to engage coupling 36 of breather insert 28. A central bore 37 may pass from first end 56 to second end 58. In the disclosed embodiment, first end 56 includes threads having an axial length of about 25 millimeters and second end 58 includes threads having an axial length of about 27 millimeters. It is contemplated, however, that first end 56 may include threads having an axial length of about 23-27 millimeters and second end 58 may include threads having an axial length of about 25-29 millimeters. In the disclosed embodiment, mounting collar 30 is fabricated from steel. It is contemplated, however, that mounting collar 30 may be assembled from any suitable material known in the art, for example, from a plastic or other metals.

Mounting collar 30 may include an outer surface 60 and an internal surface 62. Internal surface 62 may be positioned at an angle to screen 38 to provide a clearance 70 between internal surface 62 of integral spout 18 and mounting collar 30, and screen 38. In the disclosed embodiment, internal surface 62 is positioned at about a 45 degree to screen 38. It is contemplated, however, that internal surface 62 may be positioned at about a 40-50 degree to screen 38. After entering breather assembly 14 via breather cap 26, air may flow axially through upper half 50 of breather insert 28 until it reaches perforated lower half 52, whereupon the air may flow radially outward through apertures 54 into clearance 70.

A significant percentage of screen 38 and filter media 40 may be located above upper wall 16 of fluid tank 12. It is contemplated that about 75-95% of screen 38 may extend above upper wall 16 of fluid tank 12. It is further contemplated that lower half 52 of screen 38 may be in general alignment with base end 22 of integral spout 18. In the disclosed embodiment, about 85% of screen 38 extends above upper wall 16 of fluid tank 12, and about 15% of screen 38 extends into fluid tank 12. In this manner, screen 38 may be exposed to a reduced amount of hydraulic fluid during splashing and churning of hydraulic fluid in fluid tank 12.

Figure 3:
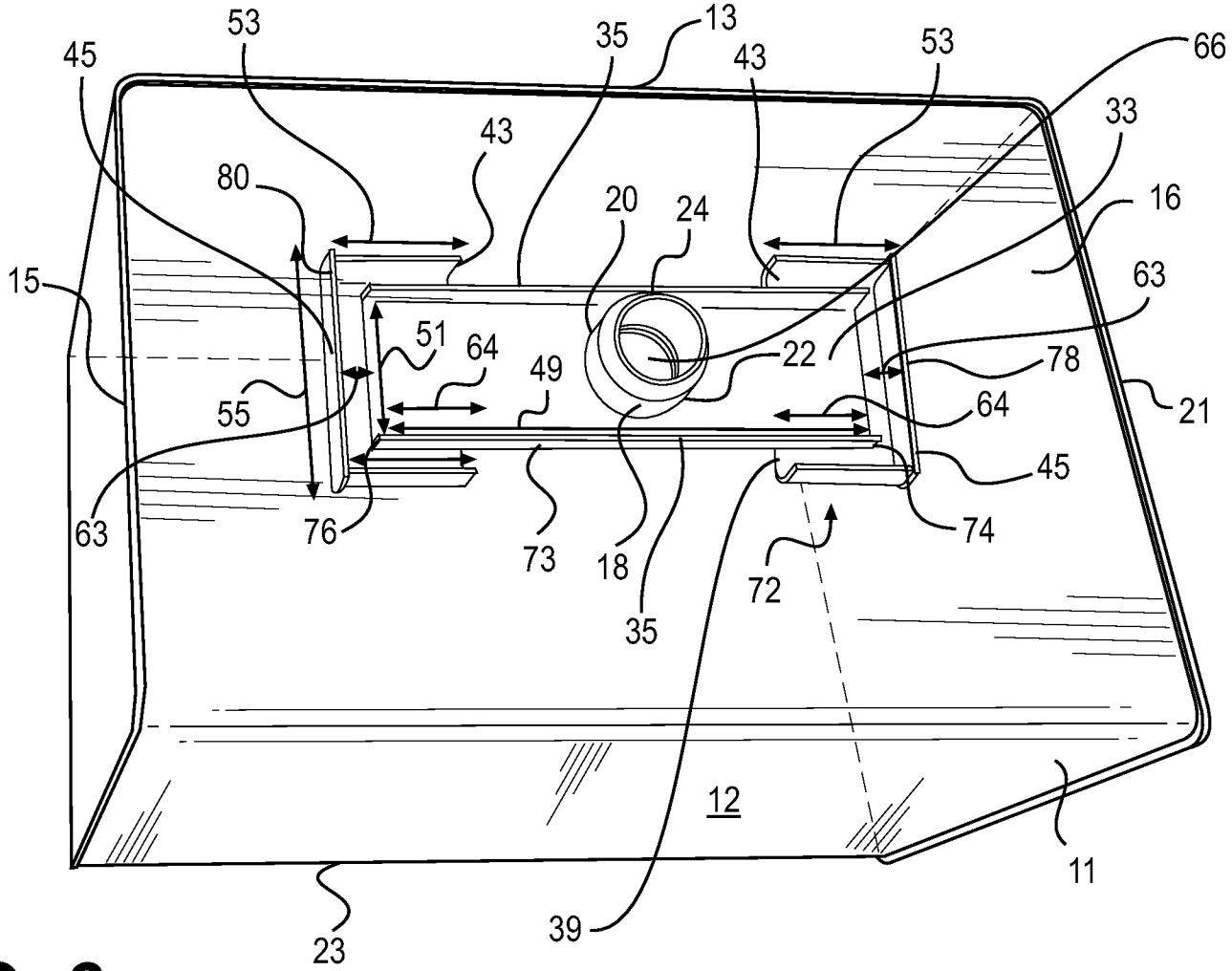
FIG. 3 is a cut-away plan view illustration of the tank assembly and splashguard of FIGS. 1 and 2.
Figure 4:
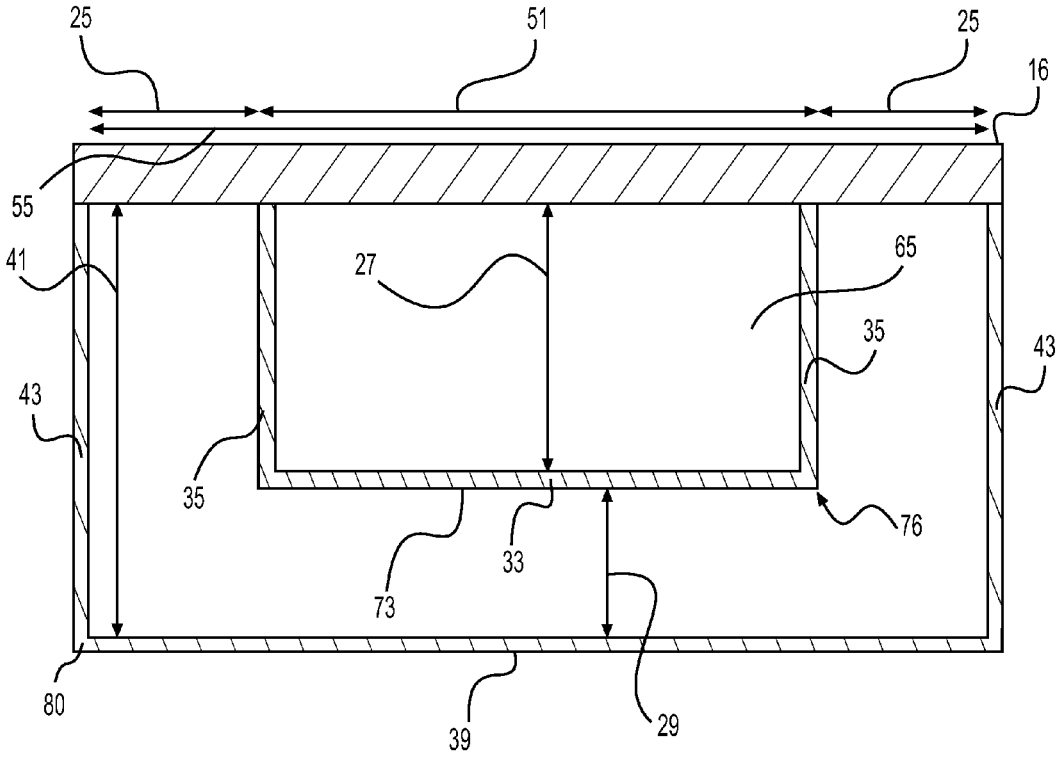
FIG. 4 is a left sectional view illustration of the splashguard of FIG. 2 taken along line 4-4 of FIG. 2.

As illustrated in FIGS. 3 and 4, splashguard 72 may be positioned below opening 20 within fluid tank 12 to receive liquids draining from breather assembly 14. Splashguard 72 may include a main channel 73, and first and second end channels 78, 80 located at first and second open ends 74, 76, respectively, of main channel 73. First end channel 78 may be substantially identical to second end Channel 80. Main channel 73 may be formed by an elongated horizontal base plate 33 having a first length 49 and a second length 51 and side walls 35 extending generally orthogonally from first length 49 by a distance 27. Side walls 35 may be connected to upper wall 16 of fluid tank 12.

First and second end channels 78, 80 may each be formed by a horizontal base plate 39 having a first length 53 and a second length 55, side walls 43 extending generally orthogonally from first length 53 by a distance 41, and an end wall 45 extending generally orthogonally from second length 55 by distance 41. Side walls 43 may be slightly curved at their bottom ends (i.e., at base plate 39) with a radius of curvature of about 9-15 millimeters. Distance 41 may be greater than distance 27. In the disclosed embodiment, distance 27 is about 30 millimeters and distance 41 is about 50 millimeters. Base plate 39 may be arranged generally parallel to base plate 33 and side walls 35 may be arranged generally parallel to side walls 43. End walls 45 and side walls 43 may be connected to upper wall 16 of fluid tank 12. In the disclosed embodiment, side walls 35, 43 and end walls 45 are fabricated from steel and are connected to upper wall 16 of fluid tank 12 by way of welding. It is contemplated, however, that side walls 35, 43 and end walls 45 may be assembled from any suitable material known in the art, if desired.

First end channel 78 may be positioned at open end 74 of main channel 73, and second end channel 80 may be positioned at open end 76 of main channel 73. First end channel 78 may receive a portion of open end 74 and second end channel 80 may receive a portion of open end 76 such that side walls 35 and side walls 43 overlap by a distance 64. Distance 64 may be about 72-78 millimeters. In the disclosed embodiment, distance 64 is about 75 millimeters.

Base plates 39 of first and second end channels 78, 80 may have combined first lengths 53 less than first length 49 of base plate 33. In the disclosed embodiment, first length 49 of base plate 33 is about 410 millimeters and second length 51 of base plate 33 is about 119 millimeters, and first length 53 of base plate 39 is about 100 millimeters and second length 55 of base plate 39 is about 172 millimeters. Base plates 33, 39, side walls 35, 43, and end walls 45 may be fabricated from plates that are about 2-6 millimeters thick. In the disclosed embodiments, base plates 33, 39, side walls 35, 43, and end walls 45 are fabricated from plates that are about 4 millimeters thick.

Side walls 43 of first and second end channels 78, 80 may be horizontally spaced apart from side walls 35 of main channel 73 by a distance 25. Distance 25 may be about 19.5-25.5 millimeters. In the disclosed embodiment, distance 25 is about 22.5 millimeters. End walls 45 of first and second end channels 78, 80 may be horizontally spaced apart from first and second open ends 74, 76 by a distance 63 (referring to FIG. 3). Distance 63 may be about 22-28 millimeters. In the disclosed embodiment, distance 63 is about 25 millimeters.

Base plate 33 of main channel 73 may be vertically spaced apart from upper wall 16 of fluid tank 12 by distance 27. Distance 27 may be about 27-33 millimeters. In the disclosed embodiment, distance 27 is about 30 millimeters. Base plate 39 of first and second end channels 78, 80 may be vertically spaced apart from base plate 33 of main channel 73 by a distance 29. Distance 29 may be about 9-15 millimeters, In the disclosed embodiment, distance 29 is about 12 millimeters. A cross-section of main channel 73 and first and second end channels 78, 80 may each be arranged generally in a U-shape (referring to FIG. 4).

A cross-sectional flow area 65 of each of first and second open ends 74, 76 of main channel 73 (referring to FIG. 4) may be greater than a cross-sectional flow area 66 of opening 20 (referring to FIG. 3). In the disclosed embodiment, opening 20 has a diameter of about 64 millimeters and a cross-sectional flow area of 3,217 square millimeters. First and second open ends 74, 76 of main channel 73 in the disclosed embodiment each have a. cross-sectional flow area of 3,570 square millimeters. En the event either of first or second open ends 74, 76 of main channel 73 becomes blocked (e.g., by hydraulic fluid), the other of first or second open ends 74, 76 of main channel 73 may provide passage for an amount of air commensurate with a capacity of opening 20. In this manner, splashguard 72 may help facilitate a steady inhaling and exhaling of air through breather assembly 14.

Splashguard 72 may be in general alignment with opening 20. In particular, a center of base plate 33 of main channel 73 along a direction of first length 49 and second length 51 may be in general alignment with opening 20. Splashguard 72 may provide multi-tiered labyrinthine flow paths 57, 59 for airflow into and out of fluid tank 12. In particular, flow path 57 may be maintained between upper wall 16 of fluid tank 12 and base plate 33 of main channel 73, and between base plate 33 of main channel 73 and base plate 39 of first end channel 78.

Flow path 59 may be maintained between upper wall 16 of fluid tank 12 and base plate 33 of main channel 73, and between base plate 33 of main channel 73 and base plate 39 of second end channel 80. Base plate 33 of main channel 73 and base plates 39 of first and second end channels 78, 80 may also obstruct hydraulic fluid from reaching breather assembly 14.

Splashguard 72 may be attached to upper wall 16 of fluid tank 12 in various configurations. In the disclosed embodiment, splashguard 72 extends in a side-to-side configuration along a length direction of fluid tank 12, generally parallel with front and rear walls 11, 13. First and second end channels 78, 80 are positioned at a distance from left- and right-side walls 15, 21 of fluid tank 12. This may permit space for mounting other important features of fluid tank 12 to upper wall 16, such as filters, for example, if desired. It is contemplated, however, that splashguard 72 may abut left- and right-side walls 15, 21 of fluid tank 12, if desired. In particular, it is contemplated that first end channel 78 may connect to one of left- or right-side walls 15, 21 and second end channel 80 may connect to the other of left- or right-side walls 15, 21. It is further contemplated that splashguard 72 may alternatively extend in a fore/aft configuration between front and rear walls 11, 13. First and second end channels 78, 80 may also be positioned at a distance from front and rear walls 11, 13, or may abut front and rear walls 11, 13, as desired.

INDUSTRIAL APPLICABILITY

The disclosed splashguard may be used with any fluid tank known in the art. For example, the splashguard of the present disclosure may be used in connection with hydraulic tanks, fuel tanks, lubrication tanks, and cooling tanks, among others. The disclosed splashguard may help reduce a discharging of undesirable contaminants into the surrounding environment of fluid tank 12.

During an exemplary operation, splashguard 72 may obstruct hydraulic fluid churning and splashing in fluid tank 12 from reaching breather assembly 14. Main channel 73 and first and second end channels 78, 80 may provide flow paths 57, 59 for air to reach breather assembly 14, while hindering an ability of hydraulic fluid to reach breather assembly 14. In particular, air may navigate through splashguard 72 by entering one of first and second end channels 78, 80 and navigating through main channel 73 to reach breather assembly 14. In contrast, hydraulic fluid may strike one of base plates 39 of first and second end channels 78, 80, or base plate 33 of main channel 73 and return to fluid tank 12.

In this manner, splashguard 72 may help reduce an exposure of breather assembly 14 to a churning and splashing of hydraulic fluid in fluid tank 12, thereby helping to decrease the discharging of entrained air into the surrounding environment. Additionally, by helping to reduce the exposure of filter media 34, 40 of breather assembly 14 to hydraulic fluid, splashguard 72 may also increase the durability and life expectancy of filter media 34, 40.

Splashguard 72 may provide additional benefits by reducing the amount of entrained hydraulic fluid in the air. In particular, main channel 73 and first and second end channels 78, 80, by virtue of their wide passages, may help reduce a velocity of air moving through splashguard 72. This reduction may help lower an amount of hydraulic fluid becoming entrained in the air. In this manner, splashguard 72 may reduce the amount of hydraulic fluid reaching breather assembly 14 and therefore a possibility of discharging entrained air into the surrounding environment.

Splashguard 72 may also provide a route for entrained hydraulic fluid to return to fluid tank 12. In particular, after navigating main channel 73 and first and second end channels 78, 80, air may flow through filter media 40 of breather assembly 14. Filter media 40 may help trap hydraulic fluid entrained in the air within the confines of filter media 40. A portion of hydraulic fluid collected in filter media 40 may be returned to fluid tank 12 via main channel 73 and first and second end channels 78, 80.

It will be apparent to those skilled in the art that various modifications and variations can be made to the disclosed splashguard without departing from the scope of the disclosure. Other embodiments of the splashguard will be apparent to those skilled in the art from consideration of the specification and practice of the splashguard disclosed herein. It is intended that the specification and examples be considered as exemplary only, with a true scope of the disclosure being indicated by the following claims and their equivalents.

What is claimed is:

1. A splashguard for a tank, comprising:

a main channel having a first open end and a second open end and formed by an elongated base plate having a first length and a second length and side walls extending generally orthogonally from the first length of the elongated base plate by a first distance and configured to connect to an upper wall of the tank;

a first end channel located at the first open end of the main channel and formed by a first base plate having a first length and a second length and side walls extending generally orthogonally from the first length of the base plate by a second distance greater than the first distance, and an end wall extending generally orthogonally from the second length of the base plate by the second distance, the side walls and the end wall configured to connect to the upper wall of the tank; and a second end channel substantially identical to the first end channel and formed by a second base plate, the second end channel located at the second open end of the main channel;

wherein a first flow path is maintained between the elongated base plate of the main channel and the end wall of the first end channel, and a second flow path is maintained between the elongated base plate of the main channel and the end wall of the second end channel.

2. The splashguard of claim 1, wherein:

the first end channel has a closed end and an open end, and the open end of the first end channel receives a first portion of the main channel; and the second end channel has a closed end and an open end, and the open end of the second end channel receives a second portion of the main channel.

3. The splashguard of claim 1, wherein:

the side walls of the main channel and the first and second end channels are configured to connect to the upper wall of the tank by way of welding; and the end walls of the first and second end channels are configured to connect to the upper wall of the tank by way of welding.

4. The splashguard of claim 1, wherein a cross-section of the main channel, the first end channel, and the second end channel are each arranged generally in a U-shape.

5. The splashguard of claim 1, wherein:

the base plate of the first end channel is arranged generally parallel to the elongated base plate of the main channel;

the base plate of the second end channel is arranged generally parallel to the elongated base plate of the main channel;

the side walls of the first end channel are arranged generally parallel to the side walls of the main channel; and the side walls of the second end channel are arranged generally parallel to the side walls of the main channel.

6. The splashguard of claim 1, wherein the elongated base plate of the main channel is spaced apart from the upper wall of the tank by about 27-33 millimeters.

7. The splashguard of claim 1, wherein the base plates of the first and second end channels are spaced apart from the elongated base plate of the main channel by about 9-15 millimeters.

8. The splashguard of claim , wherein the side walls of the first and second end channels overlap the side walls of the main channel by about 72-78 millimeters.

9. The splashguard of claim 1, wherein the side walls of the first and second end channels are spaced apart from the side walls of the main channel by about 19.5-25.5 millimeters.

10. The splashguard of claim 1, wherein:

the end wall of the first end channel is spaced apart from the first open end of the main channel by about 22-28 millimeters; and the end wall of the second end channel is spaced apart from the second open end of the main channel by about 22-28 millimeters.

11. The splashguard of claim 1, wherein the main channel is oriented to receive fluid from an opening in the upper wall of the tank.

12. The splashguard of claim 11, wherein the opening has a diameter of about 61-67 millimeters.

13. The splashguard of claim 11, wherein the opening is in general alignment with a center of the main channel along a direction of the first length and the second length of the main channel.

14. The splashguard of claim 1, wherein the main channel and the first and second end channels are fabricated from a metallic material.

15. The splashguard of claim 1, wherein:

the tank is elongated in a length direction relative to a width direction; and the splashguard extends in the length direction.

16. The splashguard of claim 1, wherein:

the tank is elongated in a length direction relative to a width direction; and the splashguard extends in the width direction.

17. A splashguard for a tank, comprising:

a main channel having a first open end and a second open end and formed by an elongated base plate having a first length and a second length and side walls extending generally orthogonally from the first length of the elongated base plate by a first distance and configured to connect to an upper wall of the tank;

a first end channel located at the first open end of the main channel and formed by a first base plate having a first length and a second length and side walls extending generally orthogonally from the first length of the base plate by a second distance greater than the first distance, and an end wall extending generally orthogonally from the second length of the base plate by the second distance, the side walls and the end wall configured to connect to the upper wall of the tank; and a second end channel substantially identical to the first end channel and formed by a second base plate, the second end channel located at the second open end of the main channel, wherein:

a first flow path is maintained between the elongated base plate of the main channel and the end wall of the first end channel;

a second flow path is maintained between the elongated base plate of the main channel and the end wall of the second end channel;

the elongated base plate of the main channel is spaced apart from the upper wall of the tank by about 27-33 millimeters;

the base plates of the first and second end channels are spaced apart from the elongated base plate of the main channel by about 9-15 millimeters;

the side walls of the first and second end channels overlap the side walls of the maim channel by about 72-78 millimeters; and the side walls of the first and second end channels are spaced apart from the side walls of the main channel by about 19.5-25.5 millimeters.

18. The splashguard of claim 17, wherein:

the tank is elongated in a length direction relative to a width direction; and the splashguard extends in the length direction.

19. The splashguard of claim 17, wherein:

the tank is elongated in a length direction relative to a width direction; and the splashguard extends in the width direction.

20. A tank, comprising:

a plurality of walls connected to each other to substantially enclose a volume, the plurality of walls including an upper wall;

an opening in the upper wall configured to receive a breather assembly;

a main channel located within the tank below the opening, the main channel having a first open end and a second open end and formed by an elongated base plate having a first length and a second length and side walls extending generally orthogonally from the first length of the elongated base plate by a first distance and configured to connect to the upper wall of the tank;

a first end channel located at the first open end of the main channel and formed by a first base plate having a first length and a second length and side walls extending generally orthogonally from the first length of the base plate by a second distance greater than the first distance, and an end wall extending generally orthogonally from the second length of the base plate by the second distance, the side walls and the end wall configured to connect to the upper wall of the tank; and a second end channel substantially identical to the first end channel and formed by a second base plate, the second end channel located at the second open end of the main channel;

wherein a first flow path is maintained between the elongated base plate of the main channel and the end wall of the first end channel, and a second flow path is maintained between the elongated base plate of the main channel and the end wall of the second end channel.

* * * * *

UNITED STATES PATENT AND TRADEMARK OFFICE

CERTIFICATE OF CORRECTION

PATENT NO. : 9,016,513 B2
APPLICATION NO. : 13/691586
DATED : April 28, 2015
INVENTOR(S) : Kulack et al.

It is certified that error appears in the above-identified patent and that said Letters Patent is hereby corrected as shown below:

Specification

Column 4, line 14, delete "26," and insert -- 26. --.

Column 5, line 1, delete "millimeters," and insert -- millimeters. --.

Column 6, line 39, delete "millimeters," and insert -- millimeters. --.

Column 6, line 51, delete "a." and insert -- a --.

Claims

Column 9, line 12 (Approx.), In claim 8, delete "claim ," and insert -- claim 1, --.

Column 10, line 17 (Approx.), In claim 17, delete "maim" and insert -- main --.

Signed and Sealed this
Twenty-ninth Day of March, 2016

Michelle K. Lee

Michelle K. Lee
*Director of the United States Patent and Trademark Office*